US009494043B1

(12) United States Patent
Lee et al.

(10) Patent No.: US 9,494,043 B1
(45) Date of Patent: Nov. 15, 2016

(54) TURBINE BLADE HAVING CONTOURED TIP SHROUD

(71) Applicant: Siemens Energy, Inc., Orlando, FL (US)

(72) Inventors: Ching-Pang Lee, Cincinnati, OH (US); Kok-Mun Tham, Oviedo, FL (US); Eric Chen, Cincinnati, OH (US); Steven Koester, Sharonville, OH (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 14/814,646

(22) Filed: Jul. 31, 2015

(51) Int. Cl.
*F01D 11/08* (2006.01)
*F01D 5/22* (2006.01)
*F01D 25/12* (2006.01)

(52) U.S. Cl.
CPC ..... *F01D 11/08* (2013.01); *F01D 5/225* (2013.01); *F01D 25/12* (2013.01); *F05D 2220/32* (2013.01); *F05D 2240/305* (2013.01); *F05D 2240/306* (2013.01); *F05D 2240/307* (2013.01); *F05D 2260/20* (2013.01)

(58) Field of Classification Search
CPC ..... F01D 11/08; F01D 11/10; F01D 11/12; F01D 11/122; F01D 11/125; F01D 11/127; F01D 5/141; F01D 5/143; F01D 5/186; F01D 5/225; F01D 5/16; F01D 25/12; F04D 29/326; F05D 2250/71; F05D 2250/711; F05D 2250/712; F05D 2250/184; F05D 2240/81; F05D 2240/80; F05D 2240/125
USPC ..... 416/92, 195
See application file for complete search history.

(56) References Cited

U.S. PATENT DOCUMENTS

2008/0292466 A1* 11/2008 Tragesser ..... F01D 5/225 416/223 R

* cited by examiner

*Primary Examiner* — Eric Keasel
*Assistant Examiner* — Danielle M Christensen

(57) ABSTRACT

A turbine blade includes an airfoil and a shroud coupled to a tip of the airfoil. The shroud includes a mid portion positioned directly above the tip of the airfoil. The mid portion includes a ramped radially outer surface extending from a first edge to a second edge in the direction from a pressure side toward a suction side of the airfoil, the second edge being positioned further radially inward than the first edge. In a first aspect, the shroud may include a curved pressure side portion positioned upstream of the pressure side of the airfoil, the pressure side portion being curved radially inward. In a second aspect, the shroud may include a curved suction side portion positioned downstream of the suction side of the airfoil, the suction side portion being curved radially outward.

20 Claims, 9 Drawing Sheets

View V-V

View VI-VI

TURBINE BLADE HAVING CONTOURED TIP SHROUD

BACKGROUND

1. Field

This invention is directed generally to turbine blades, and more particularly to a shrouded turbine blade.

2. Description of the Related Art

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures.

A turbine blade is formed from a root portion at one end and an elongated portion forming an airfoil that extends outwardly from a platform coupled to the root portion. The blade is ordinarily composed of a tip opposite the root section, a leading edge, and a trailing edge. The tip of a turbine blade often has a tip feature to reduce the size of the gap between ring segments and blades in the gas path of the turbine to prevent tip flow leakage, which reduces the amount of torque generated by the turbine blades. Some turbine blades include tip shrouds, as shown in FIG. 1A, attached to the blade tips.

Tip leakage loss, as shown in FIG. 1B, is essentially lost opportunity for work extraction and also contributes towards aerodynamic secondary loss. To reduce over-tip leakage, shrouded blades typically include a circumferential knife edge for running tight tip gaps. The turbine tip shrouds are also used for the purpose of blade damping.

A tip shroud increases the weight at the blade tip and contributes to extra loadings to the blade lower section, caused by centrifugal forces resulting from the weight of the shroud. Some modern tip shrouds are scalloped, as opposed to a full ring, to reduce shroud weight and hence lower blade centrifugal pull loads, with mechanical support being provided through the knife edge seal. The material removed by scalloping is indicated by the shaded region in FIG. 1A. The removal of material by scalloping is detrimental to turbine aerodynamic efficiency, as the shroud coverage is now reduced leading to an increase in parasitic leakage.

SUMMARY

Briefly, aspects of the present invention provide a turbine blade having a contoured tip shroud.

According to a first aspect of the invention, a turbine blade is provided, comprising a generally elongated airfoil having a leading edge, a trailing edge, a pressure side and a suction side on a side opposite to the pressure side, and a shroud coupled to a tip of the airfoil at a radially outer end of the airfoil. The shroud extends in a direction generally from the pressure side toward the suction side and extends circumferentially in a turbine engine. A knife edge seal extends radially outward from the shroud. The shroud comprises a mid portion positioned directly over the tip of the airfoil. The mid portion comprises a ramped radially outer surface extending from a first edge to a second edge in the direction from the pressure side toward the suction side, the second edge being positioned further radially inward than the first edge. The shroud further comprises a pressure side portion positioned upstream of the pressure side of the airfoil and extending from the first edge to a pressure side edge of the shroud. The pressure side portion is curved radially inward, wherein a radially inner surface of the pressure side portion forms a concave surface and a radially outer surface of the pressure side portion forms a convex surface. The pressure side edge is positioned further radially inward than the first edge.

According to a second aspect of the invention, a turbine blade is provided, comprising a generally elongated airfoil having a leading edge, a trailing edge, a pressure side and a suction side on a side opposite to the pressure side, and a shroud coupled to a tip of the airfoil at a radially outer end of the airfoil. The shroud extends in a direction generally from the pressure side toward the suction side and extends circumferentially in a turbine engine. A knife edge seal extends radially outward from the shroud. The shroud comprises a mid portion positioned directly over the tip of the airfoil. The mid portion comprises a ramped radially outer surface extending from a first edge to a second edge in the direction from the pressure side toward the suction side. The second edge is positioned further radially inward than the first edge. The mid portion further includes a wall surface extending radially outward from the second edge to a third edge. The shroud further comprises a suction side portion positioned downstream of the suction side of the airfoil and extending from the third edge to a suction side edge of the shroud. The suction side portion is curved radially outward, wherein a radially inner surface of the suction side portion forms a convex surface and a radially outer surface of the suction side portion forms a concave surface. The suction side edge is positioned further radially outward than the third edge.

According to a third aspect of the invention, a turbine stage is provided, comprising a row of turbine blades arranged circumferentially spaced apart to define respective passages therebetween for channeling a main gas flow. Each turbine blade comprises a generally elongated airfoil having a leading edge, a trailing edge, a pressure side and a suction side on a side opposite to the pressure side, and a shroud coupled to a tip of the airfoil at a radially outer end of the airfoil. Each shroud extends in a direction generally from the pressure side toward the suction side and extends circumferentially in a turbine engine. A knife edge seal extends radially outward from the shroud. The shroud of each blade comprises a mid portion positioned directly over the tip of the airfoil and comprising a ramped radially outer surface extending from a first edge to a second edge in the direction from the pressure side toward the suction side, the second edge being positioned further radially inward than the first edge. The mid portion further includes a wall surface extending radially outward from the second edge to a third edge. The shroud of each blade further comprises a pressure side portion positioned upstream of the pressure side of the airfoil and extending from the first edge to a pressure side shroud edge. The pressure side portion is curved radially inward, wherein a radially inner surface of the pressure side portion forms a concave surface and a radially outer surface of the pressure side portion forms a convex surface. The pressure side shroud edge is positioned further radially inward than the first edge. The shroud of each blade further comprises a suction side portion positioned downstream of the suction side of the airfoil and extending from the third edge to a suction side shroud edge. The suction side portion is curved radially outward, wherein a radially inner surface of the suction side portion forms a convex surface and a radially outer surface of the suction side portion forms a concave surface. The suction side shroud edge is positioned further radially outward than the third edge. A circumferential gap is defined between the suction side shroud edge of a first turbine blade and the pressure side shroud edge of a circumferentially adjacent second turbine blade.

In one embodiment, a plurality of coolant ejection holes may be positioned on the ramped radially outer surface of the mid portion, the plurality of coolant ejection holes being connected fluidically to an interior of the airfoil.

In one embodiment, the mid portion may be formed by a cutout defining a region of reduced mass of the shroud over the tip of the airfoil.

In at least one embodiment, the radially inner surface and the radially outer surface of the pressure side portion may be connected at the pressure side edge of the shroud. In at least one embodiment, the radially inner surface and the radially outer surface of the suction side portion may be connected at the suction side edge of the shroud.

In one embodiment, the second edge may be generally aligned with a contour of the suction side at the tip of the airfoil, and the first edge may be generally aligned with a contour of the pressure side at the tip of the airfoil.

In at least one embodiment, the ramped radially outer surface makes an angle with the wall surface that may vary in a direction from the leading edge to the trailing edge as a function of a profile of the airfoil at the tip.

In one embodiment, the shroud may have a forward section extending from the knife edge seal toward the leading edge and an aft section extending from the knife edge seal toward the trailing edge. The mid portion, in combination with the pressure side and/or suction side portion, may be positioned at the forward section of the shroud.

BRIEF DESCRIPTION OF THE DRAWINGS

The invention is shown in more detail by help of figures. The figures show preferred configurations and do not limit the scope of the invention.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

A gas turbine engine may comprise a compressor section, a combustor and a turbine section. The compressor section compresses ambient air. The combustor combines the compressed air with a fuel and ignites the mixture creating combustion products comprising hot gases, that form a main gas flow. The main gas flow travels to the turbine section. Within the turbine section are circumferential rows of vanes and blades, the blades being coupled to a rotor. Each pair of rows of vanes and blades forms a stage in the turbine section. The turbine section comprises a fixed turbine casing, which houses the vanes, blades and rotor.

Figure 1A:
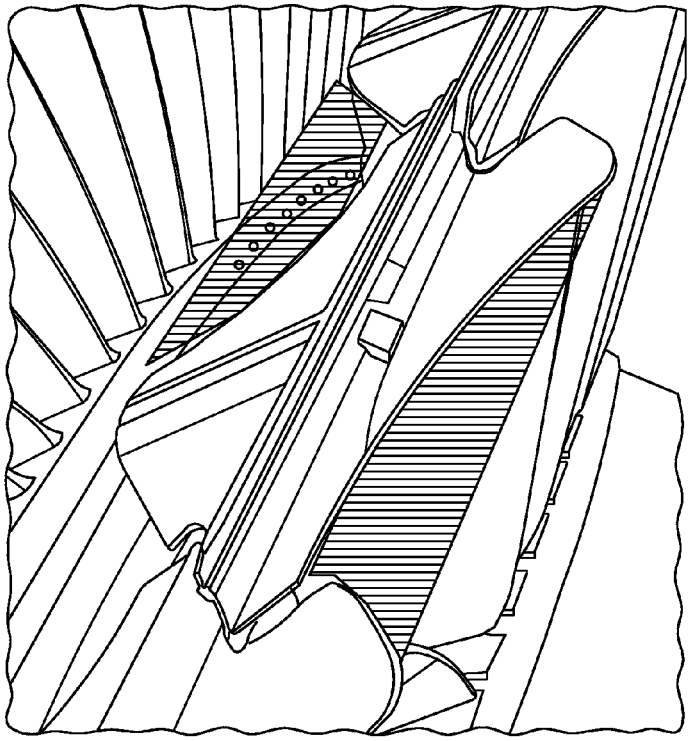
FIG 1A PRIOR ART
FIG. 1A is a perspective view of a conventional turbine blade with a tip shroud.
Figure 1B:
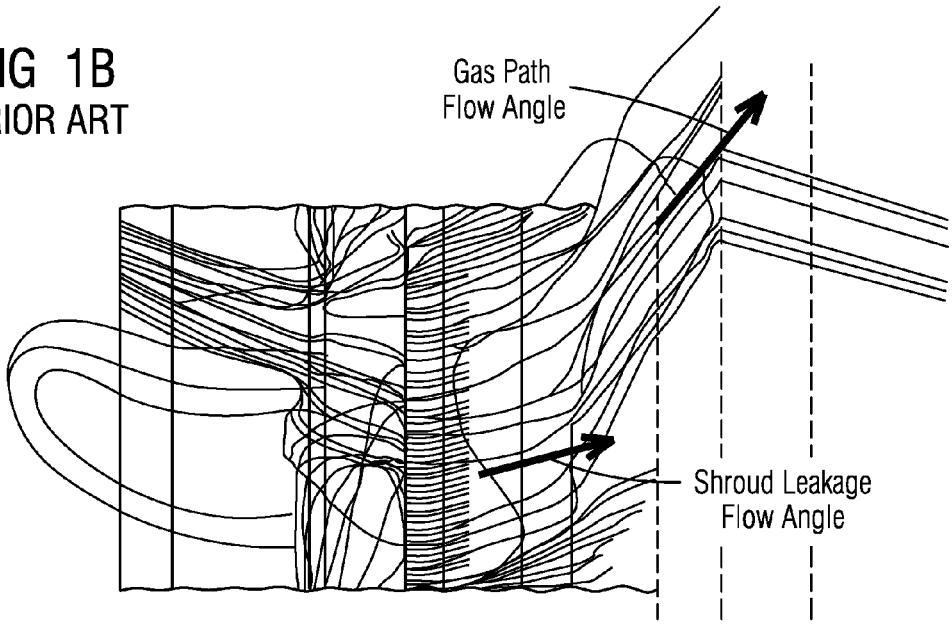
FIG 1B PRIOR ART
FIG. 1B is a perspective view of the conventional turbine blade shown together with leakage flow and main gas flow.
Figure 2:
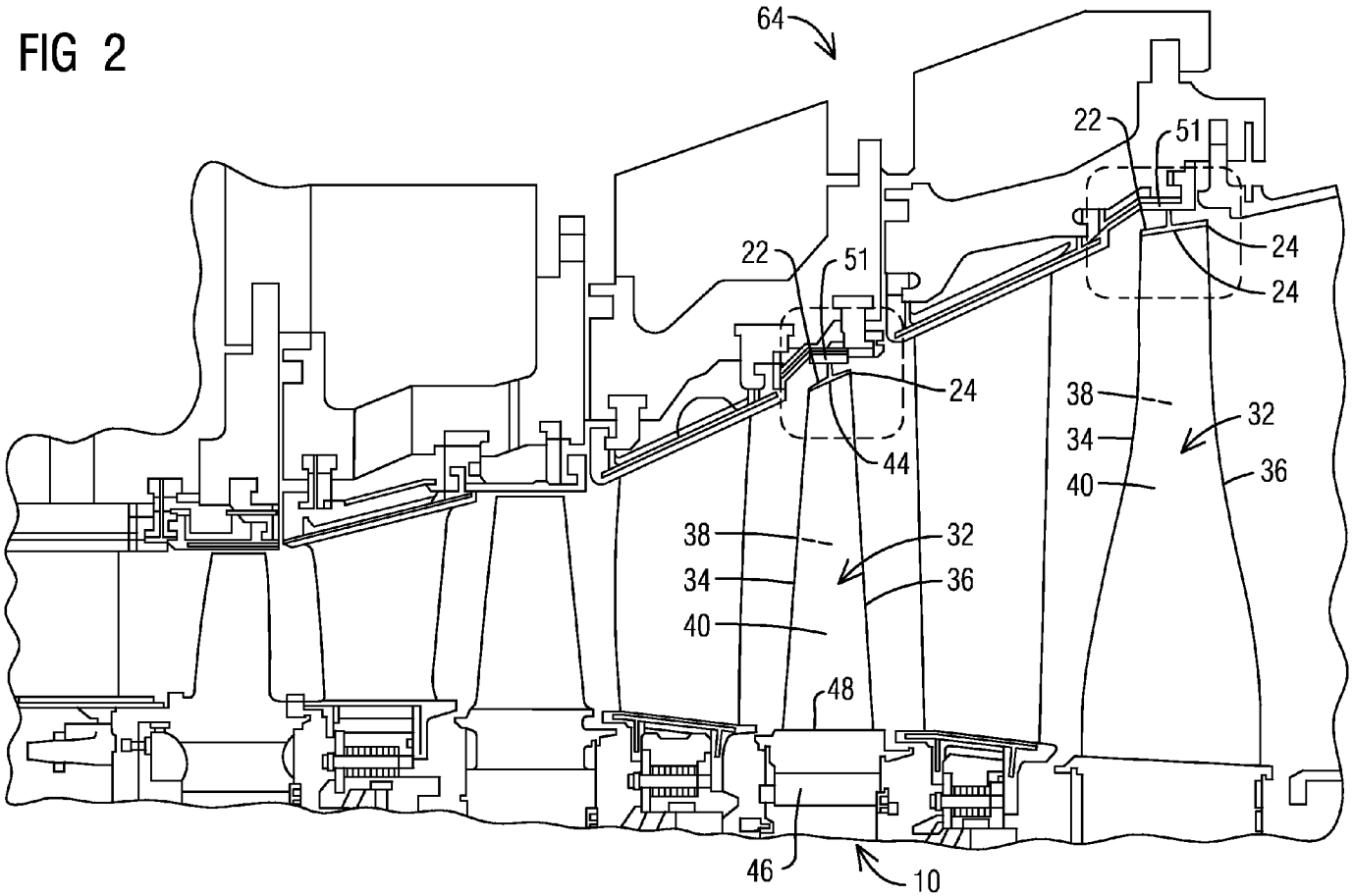
FIG. 2 is a perspective view of a gas turbine engine with a row of shrouded turbine blades wherein aspects of the present invention may be incorporated.

Referring now to FIG. 2, a portion of a turbine section of a gas turbine engine 64 is shown, which comprises a row of turbine blades 10 wherein embodiments of the present invention may be incorporated. The blades 10 are circumferentially spaced apart from each other to define respective flow passages between adjacent blades 10, for channeling a main gas flow F (see FIG. 3). Each turbine blade 10 is formed from a generally elongated airfoil 32 extending in a generally radial direction in the turbine engine 64 from a rotor disc. The airfoil 32 includes a leading edge 34, a trailing edge 36, a pressure side 38, a suction side 40 on a side opposite to the pressure side 38, a tip 24 at a radially outer end 44 of the airfoil 32, a root 46 coupled to the airfoil 32 at a radially inner end 48 of the airfoil 32 for supporting the airfoil 32 and for coupling the airfoil 32 to the rotor disc. Each turbine blade 10 may include one or more shrouds 22, referred to as tip shrouds, coupled to the tip 24 of the generally elongated airfoil 32. The shroud 22 may extend in a direction generally from the pressure side 38 toward the suction side 40 and may extend circumferentially in the turbine engine 64 (see FIG. 3). A knife edge seal 50 extends radially outward from the shroud 22 and further extends in a circumferential direction of the turbine engine 64, running tight tip gaps against a honeycomb structure 51 on the stator of the turbine engine. 64, thereby reducing over-tip leakage.

Figure 3:
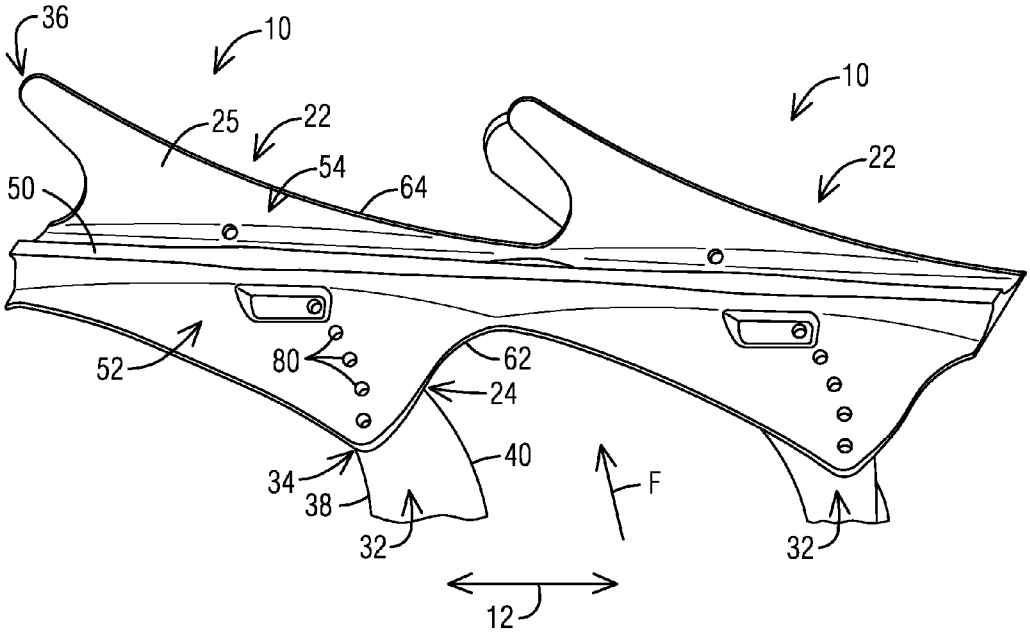
FIG. 3 is a perspective top view in a direction from a turbine casing toward a rotor hub illustrating a pair of circumferentially adjacent shrouded turbine blades.

FIG. 3 shows a radial top view of a row of turbine blades 10 having tip shrouds 22. In this configuration, each shroud 22 may have a forward section 52 extending upstream of the knife edge seal 50 with respect to the main gas flow F and an aft section 54 extending downstream of the knife edge seal 50 with respect to the main gas flow F. The forward section 52 extends from the knife edge seal 50 toward the leading edge 34 of the airfoil 32 and ends at a forward edge 62. The aft section 54 extends from the knife edge seal 50 toward the trailing edge 36 of the airfoil 32 and ends at an aft edge 64. In the configuration shown in FIG. 3, the forward and aft edges 62 and 64 are scalloped along the circumferential direction 12, to reduce shroud weight.

Optionally, a plurality of coolant passages 80 may be provided on the shroud 22. The coolant passages 80 open through a radially outer surface 25 of the shroud 22 and direct a coolant from a hollow interior of the airfoil 32 to provide film cooling on the radially outer surface 25 of the shroud 22. The coolant ejected through the passages 80, along with the over-tip leakage flow, eventually enters the main gas flow F.

Referring to FIG. 4-7, a turbine blade 10 with a contoured tip shroud 22 is illustrated according to an exemplary embodiment of the present invention. The shroud 22 comprises a pressure side portion 94 positioned upstream of the pressure side 38 of the airfoil 32, a suction side portion 96 positioned downstream of the suction side 40 of the airfoil 32 and a mid portion 92 positioned directly above the tip 24 of the airfoil 32, the mid portion 92 being located between the pressure side portion 94 and the suction side portion 96. In this description, the terms "upstream of the pressure side" and "downstream of the suction side" are defined in relation to a leakage flow which takes place generally in a direction from the pressure side 38 toward the suction side 40 of the airfoil 32. In accordance with aspects of the present invention, the shroud 22 is contoured along the direction from the pressure side 38 toward the suction side 40. In particular, the mid portion 92 may have a ramped contour, extending radially inward in the direction from the pressure side 38 toward the suction side 40 of the airfoil 32. Additionally, the pressure side portion 94 and/or the suction side portion 96 may have a curved contour. For example, in a first aspect, in cooperation with the ramped mid portion 92, the pressure side portion 94 may be curved radially inward. In a second aspect, in cooperation with the ramped mid portion 92, the suction side portion 96 may be curved radially outward. In an exemplary embodiment, for example as illustrated in FIGS. 4-7, the features of the aforementioned first and second aspects may be combined, whereby the tip shroud 22 may comprise a ramped mid portion 92 in combination with a radially inwardly curved pressure side portion 94 and a radially outwardly curved suction side portion 96.

The shroud 22 includes a forward section 52 extending from the knife edge seal 50 toward the leading edge 34 of the airfoil 32 and an aft section 54 extending from the knife edge seal 50 toward the trailing edge 36 of the airfoil 32. In the example illustrated in FIGS. 4-7, the shroud 22 is contoured at the forward section 52. That is, the illustrated mid portion 92, pressure side portion 94 and suction side portion 96 are present at the forward section 52 of the shroud 22, with the aft section 54 remaining substantially similar to that in the configuration of FIG. 3. However, in a further embodiment (not shown), aspects of the inventive concept may be extended to the aft section 54.

The mid portion 92 comprises a ramped radially outer surface 25*a* extending from a first edge 74 to a second edge 76 in the direction from the pressure side 38 toward the suction side 40. The ramp is oriented such that second edge 76 is positioned further radially inward than the first edge 74. The radially inward ramp from the pressure side 38 to the suction side 40 increases flow area locally at the shroud 22 in the circumferential direction, resulting in a decrease in flow velocity and increase in pressure. This results in a pressure surface on the shroud to encourage work extraction.

Figure 4:
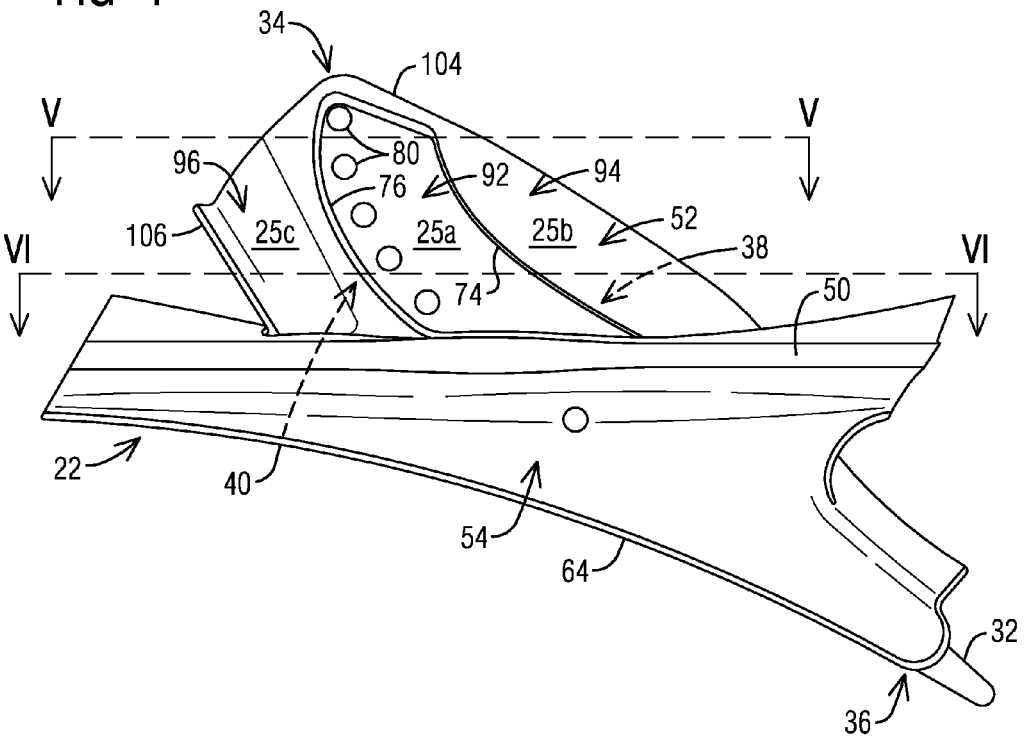
FIG. 4 is a perspective top view in a direction from a turbine casing toward a rotor hub illustrating a turbine blade having a contoured tip shroud according to one embodiment of the invention.
Figure 5:
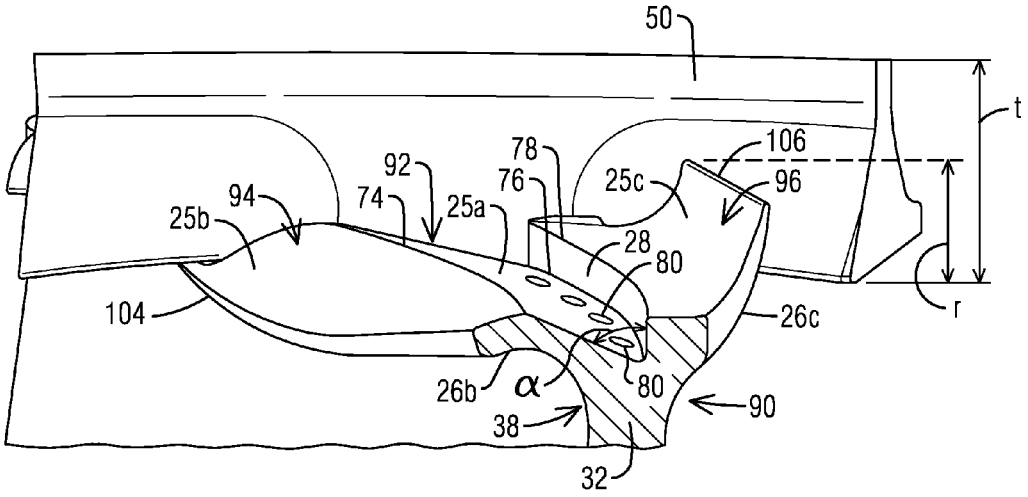
FIG. 5 is a view along the section V-V in FIG. 4 looking in a direction from forward to aft.
Figure 6:
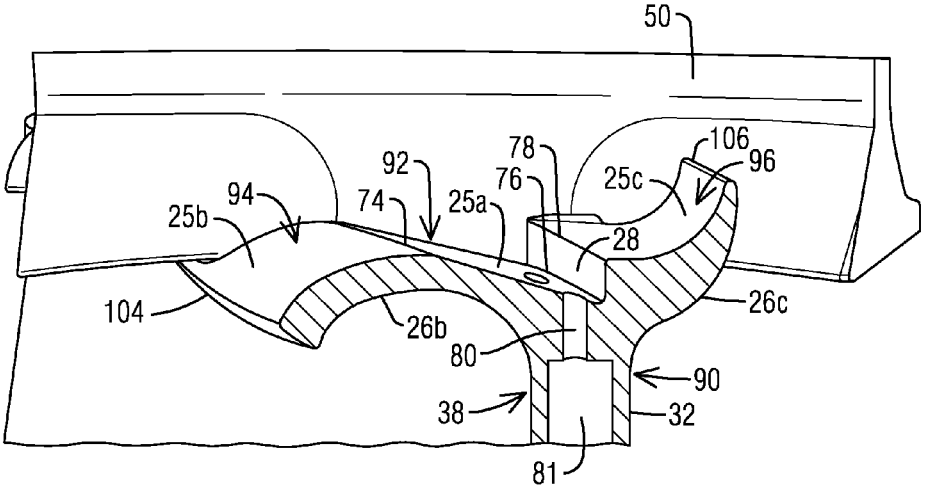
FIG. 6 is a view along the section VI-VI in FIG. 4 looking in a direction from forward to aft.
Figure 7:
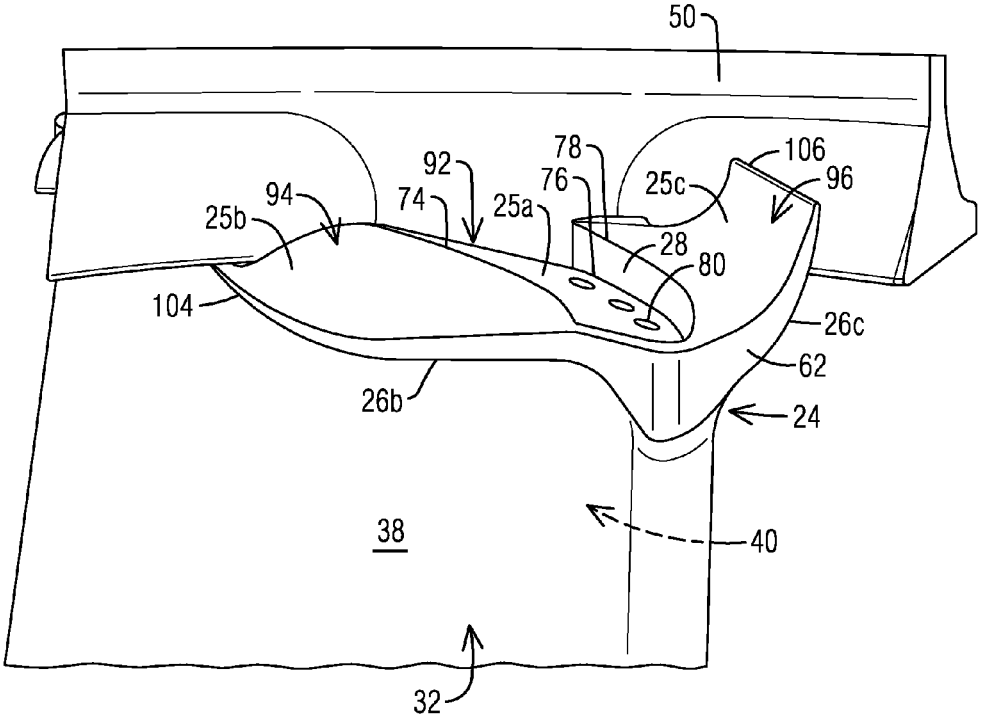
FIG. 7 is a perspective view, looking forward to aft, showing a forward section of a turbine blade with a contoured tip shroud according to the illustrated embodiment.

As illustrated in FIGS. 4 and 6, a plurality of coolant ejection holes 80 may be positioned on the ramped radially outer surface 25*a*. The coolant ejection holes 80 direct a coolant flow from an interior 81 of the airfoil 32 to provide film cooling on the radially outer surface of the shroud 22. As particularly shown in FIG. 4, the second edge 76 may be generally aligned with a contour of the suction side 40 at the tip 24 of the airfoil 32. In this example, since the mid portion 92 is positioned at the forward section 52, the second edge 76 generally follows the contour of the suction side 40 at the airfoil tip 24 from the leading edge 34 up to the knife edge seal 50. The first edge 74 may be generally aligned with a contour of the pressure side 38 at the tip 24 of the airfoil 32. In this example, since mid portion 92 is positioned at the forward section 52, the first edge 74 generally follows the contour of the pressure side 38 at the airfoil tip 24 from the leading edge 34 up to the knife edge seal 50. As shown in FIGS. 5-7, a wall surface 28 may extend radially outward from the second edge 76 to a third edge 78. In the shown embodiment, the wall surface 28 extends substantially parallel to the radial direction, such that the third edge 78 is also aligned with the contour of the suction side 40 at the airfoil tip 24. In alternate embodiments, the wall surface 28 may extend at an angle with respect to the radial direction. The third edge 78 may be at the same radial height as the first edge 74. The ramped radially outer surface 25*a* makes an angle $\alpha$ (see FIG. 5) with the wall surface 28 that defines a ramp gradient. The angle that the ramped radially outer surface 25*a* makes with the wall surface 28 may be related to the profile of the airfoil 32. For example, the angle of the ramp may vary so as to be progressively shallower in a direction from the leading edge 34 toward the trailing edge 36 of the airfoil profile, as may be discerned particularly from FIGS. 5 and 6. Features of the illustrated embodiment align over-tip leakage flow as well as the ejected coolant flow from the holes 80 to match the main gas flow, resulting in reduced aerodynamic loss upon re-introduction of the over-tip leakage flow into the main gas path. The angular orientation of the ramped radially outer surface 25*a* with the wall surface 28 provides a fence-like structure to shield the over-tip leakage flow and the coolant ejected from the holes 80 from flowing from the pressure side 38 to the suction side 40 of the airfoil 32. Such a feature promotes work extraction in the shroud cavity.

In one embodiment, the mid portion 92 may be formed by a cutout on the shroud 22 directly over the tip 24 of the airfoil 32. The cutout defines a region of reduced mass of the shroud 22. This results in reduced airfoil stress and reduced airfoil section required to carry the shroud load, which in turn results in reduced aerodynamic profile loss, thereby increasing aerodynamic efficiency of the airfoil 32. The reduced airfoil stress also increases blade creep resistance.

The pressure side portion 94 extends upstream of the pressure side 38 of the airfoil 32, from the first edge 74 to a pressure side edge 104 of the shroud 22. In accordance with the illustrated embodiment, the pressure side portion 94 is curved radially inward. In this case, a radially inner surface 26*b* of the pressure side portion 94 forms a concave surface and a radially outer surface 25*b* of the pressure side portion 94 forms a convex surface. The pressure side edge 104 is positioned further radially inward than the first edge 74. The radially inner surface 26*b* and the radially outer surface 25*b* of the pressure side portion 94 are connected at the pressure side edge 104 of the shroud 22. In the embodiment shown in FIGS. 5-7, the pressure side edge 104 is positioned further radially inward than a base of the knife edge seal 50.

The suction side portion 96 extends downstream of the suction side 40 of the airfoil 32, from the third edge 78 to a suction side edge 106 of the shroud 22. In accordance with the illustrated embodiments, the suction side portion 96 is curved radially outward. In this case, a radially inner surface 26*c* of the suction side portion 96 forms a convex surface and a radially outer surface 25*c* of the suction side portion 96 forms a concave surface. The suction side edge 106 is positioned further radially outward than the third edge 78. The radially inner surface 26*c* and the radially outer surface 25*c* of the suction side portion 96 are connected at the suction side edge 106 of the shroud 22. In an example embodiment, the suction side edge 106 of the shroud 22 intersects the knife edge seal 50 at a radial height r which lies between 40-60% of a radial height t of the knife edge seal 50 (see FIG. 5).

FIG. 7 is a perspective view, looking forward to aft, showing a forward section 52 of a turbine blade with a contoured tip shroud 22 according the illustrated embodiment. As seen, the forward edge 62 of the shroud 22 is contoured, extending from the pressure side edge 104 to the suction side edge 106 of the shroud 22. The curvature of the pressure side portion 94 and/or the suction side portion 96 may vary in a direction from the forward edge 62 of the shroud toward the knife edge seal 50. In the illustrated embodiment (see FIGS. 5-7), the curvatures of both the pressure side portion 94 and the suction side portion 96 are smaller toward the knife edge seal 50 and larger toward the forward edge 62 of the shroud. As a result of the contouring of the pressure side portion 94 and/or suction side portion 96, the forward edges 62 of adjacent shrouds 22 no longer adjoin, as in the configuration of FIG. 3, but instead define a circumferential gap P (see FIG. 9) between the suction side shroud edge 106 of a first turbine blade and the pressure side shroud edge 104 of a circumferentially adjacent second turbine blade.

Figure 8:
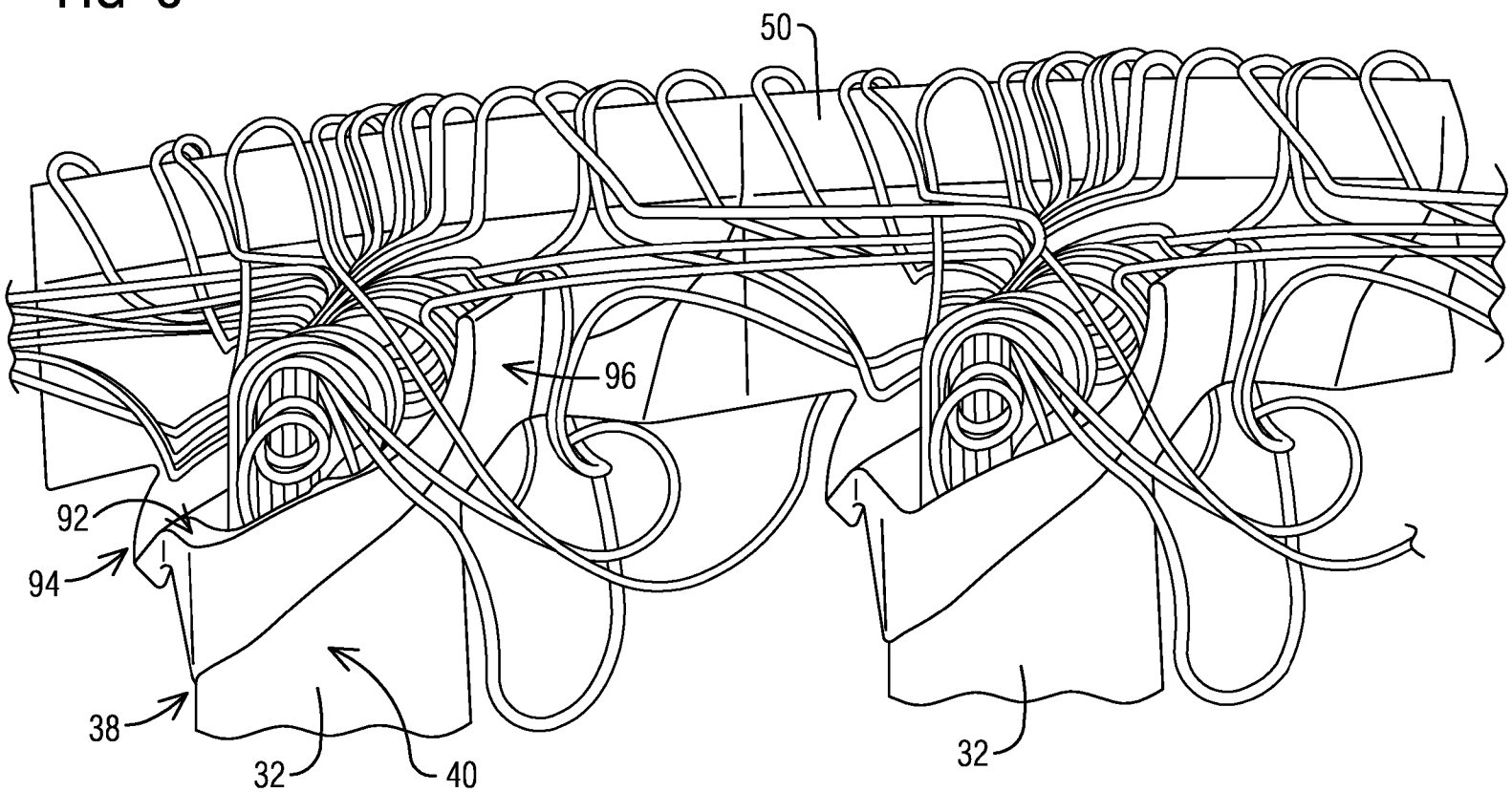
FIG. 8 illustrates streamlines seeded from coolant ejection holes at a forward section of a contoured tip shroud according to embodiments of the present invention.
Figure 9:
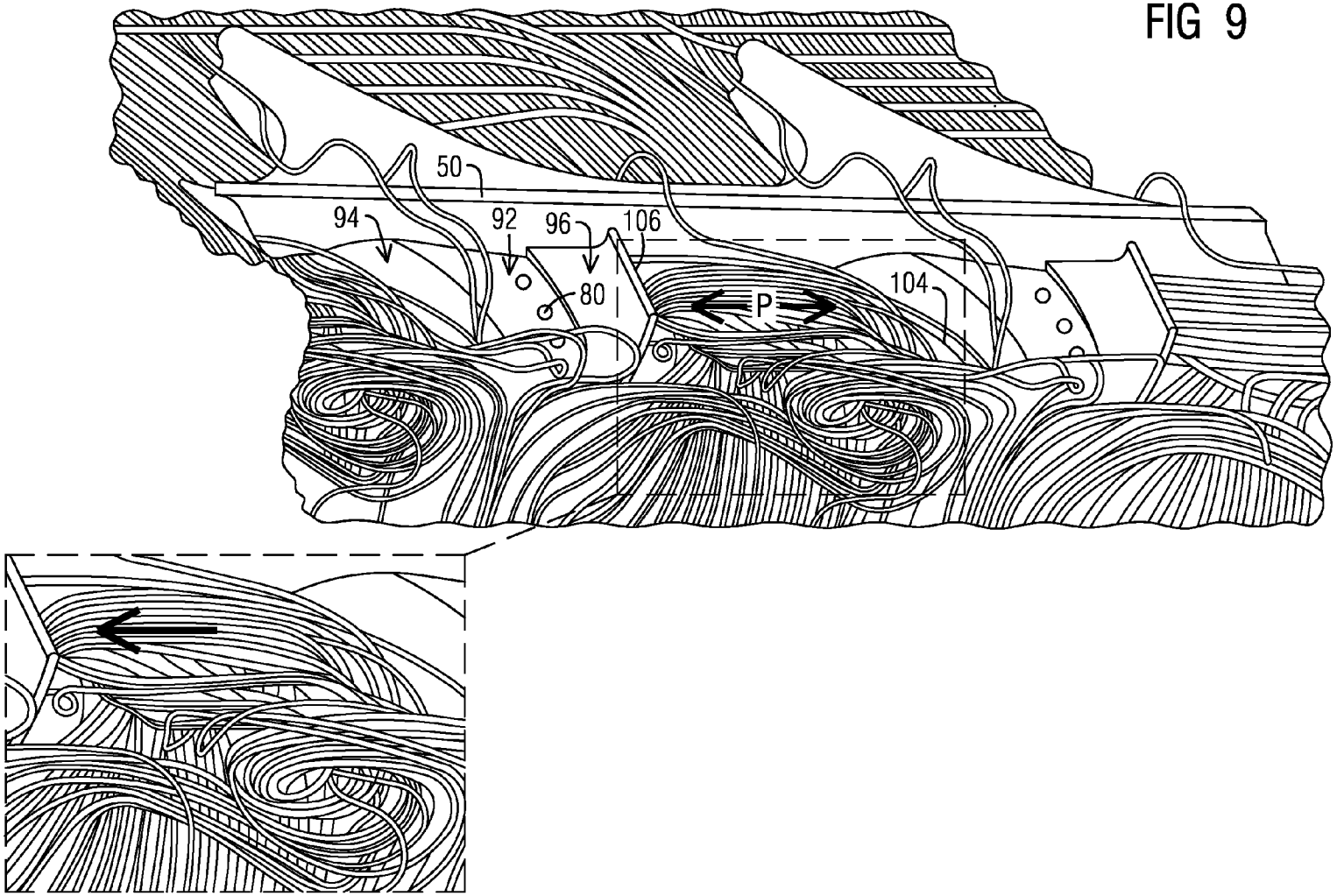
FIG. 9 illustrates streamlines seeded from inflow of the main gas flow between adjacent shrouded turbine blades according to embodiments of the present invention.

The radially inwardly curved contour of the pressure side portion 92 ensures that most of the gas path fluid remains radially underneath the tip shroud 22, leaving mostly coolant ejected from the holes 80 to flow over the tip shroud 22. The above effect may be illustrated referring to FIGS. 8 and 9. FIG. 8 illustrates streamlines seeded from coolant ejection holes at the forward section of a contoured tip shroud while FIG. 9 illustrates streamlines seeded from inflow of the gas path fluid between adjacent shrouded turbine blades, in an exemplary engine configuration in accordance with the illustrated embodiments. As seen in FIGS. 8 and 9, the ejected coolant dominates the flow radially over the tip shroud 22, which creates an aero-blocking effect to discourage the gas path fluid from crossing over the knife edge seal 50, thereby reducing axial leakage significantly.

Figure 11:
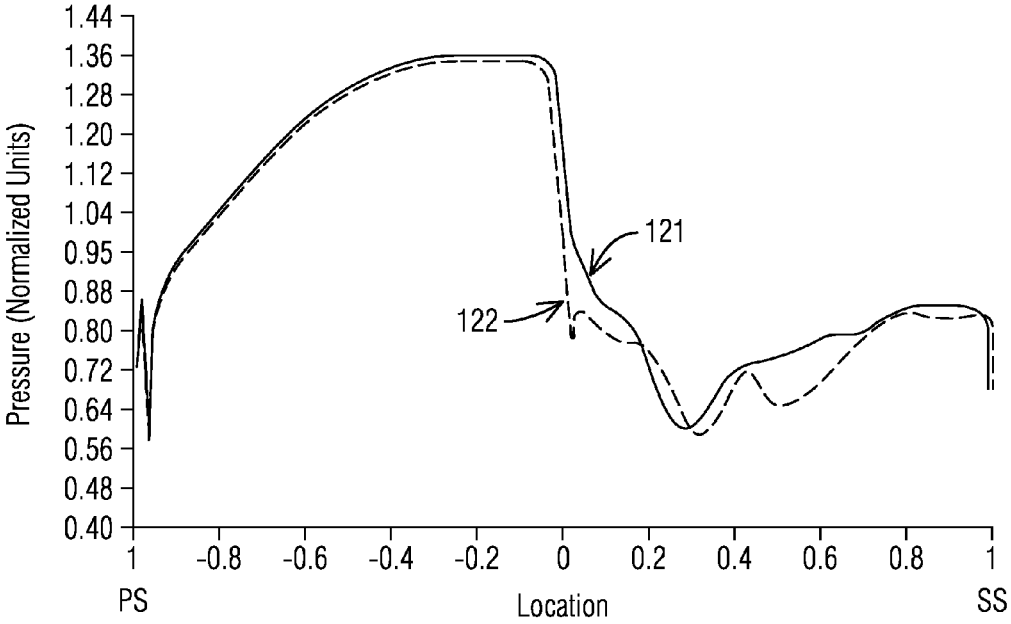
FIG. 11 is a graphical illustration of a variation in pressure from a pressure side edge to a suction side edge in a forward section of a contoured tip shroud, according to embodiments of the present invention.
Figure 10A:
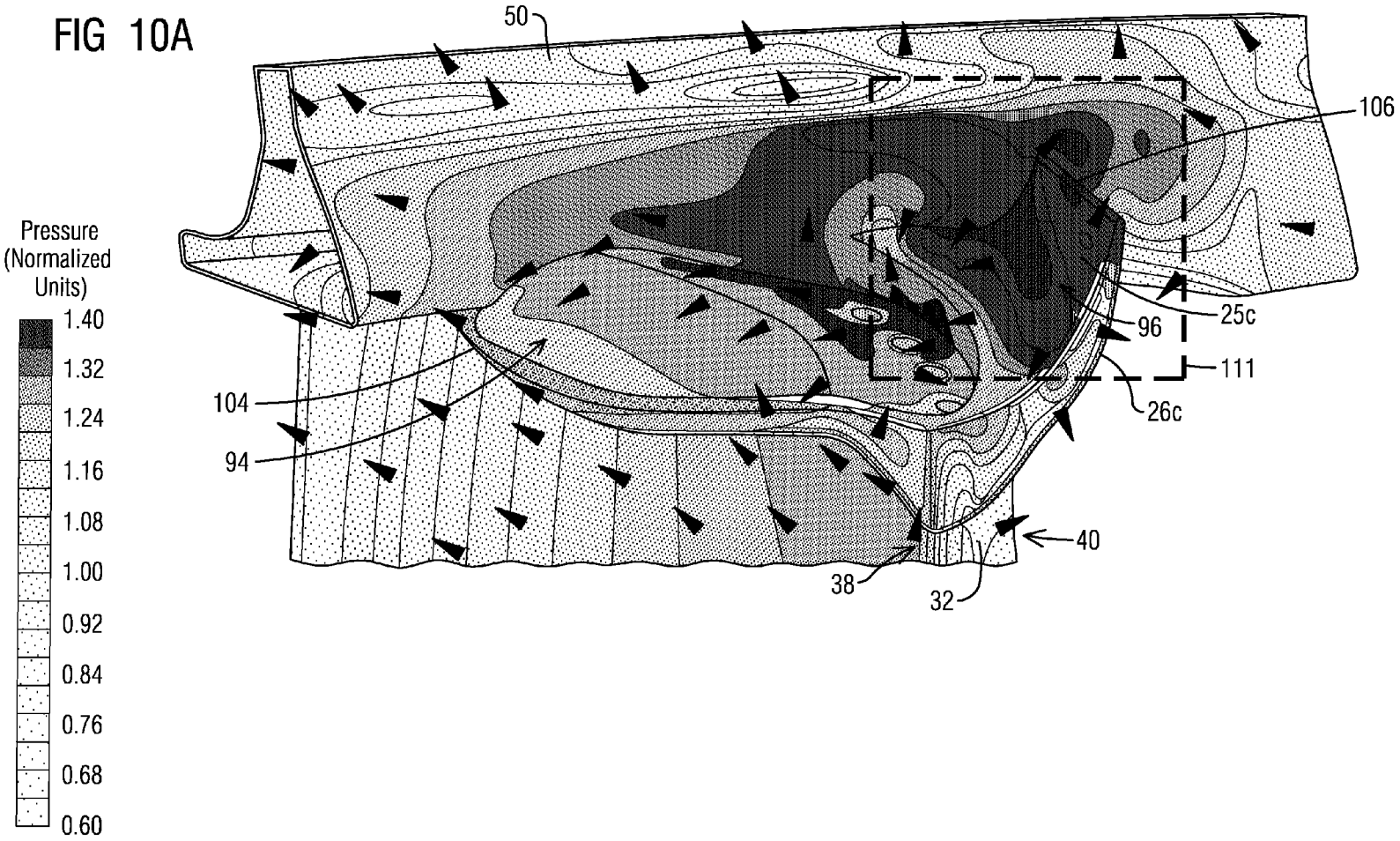
FIGS. 10A-B illustrate surface streamlines and pressure distribution around a contoured tip shroud according to embodiments of the present invention.
Figure 10B:
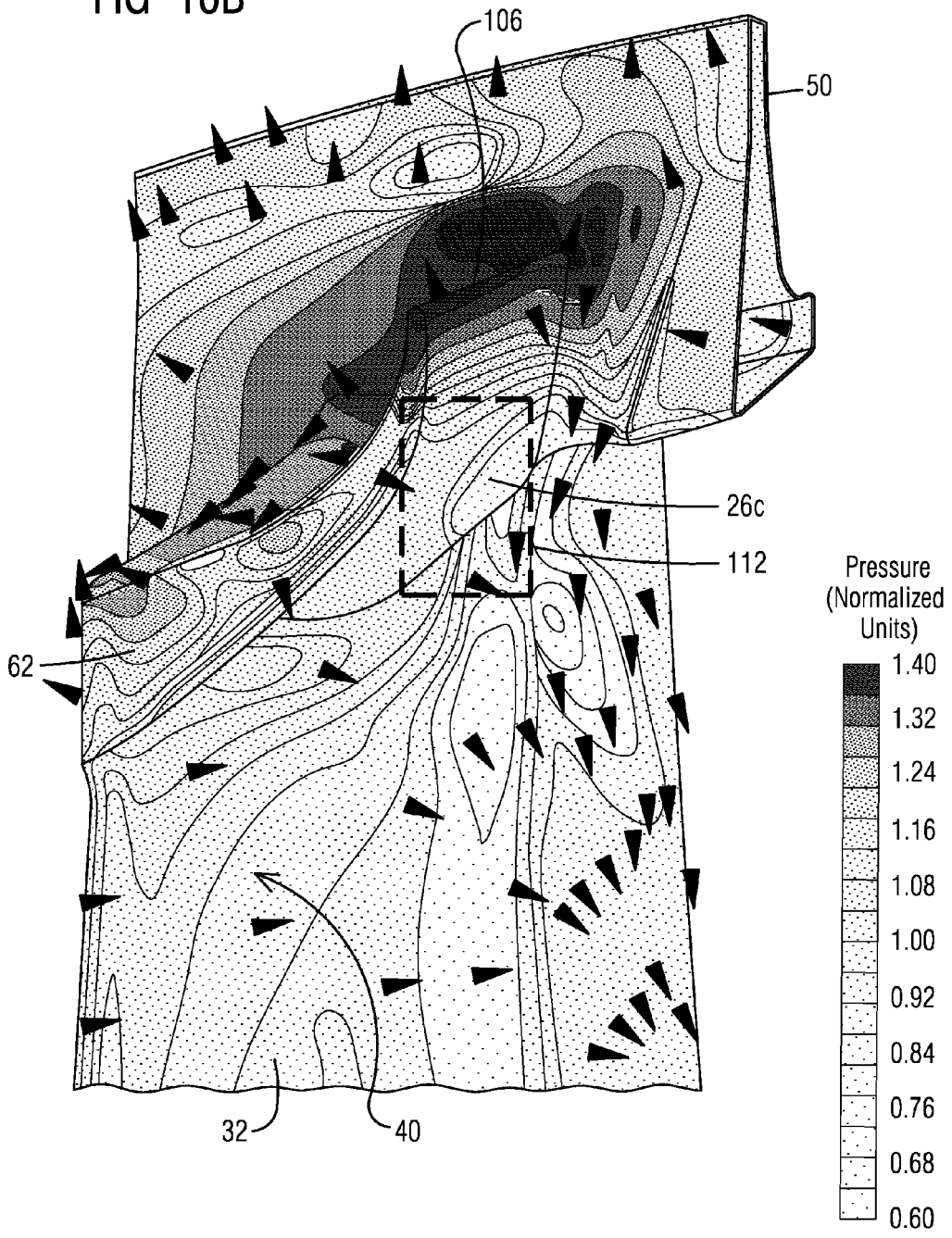

The radially outwardly curved contour of the suction side portion 96 actively discourages over-tip leakage flow and ejected coolant flow from spilling over into the suction side 40 of the airfoil 32. This effect may be explained referring to FIGS. 10A and 10B, which illustrate pressure distribution and surface streamlines of all flow around a contoured tip shroud according embodiments of the present invention. As seen in FIG. 10A, the radially outwardly curved contour of the suction side portion 96 creates a high pressure region 111 over the concave radially outer surface 25*c* of the suction side portion 96. Furthermore, as may be seen from FIG. 10B, a region of low pressure 112 is created at the convex radially inner surface 26*c* of the suction side portion 96. The shifting of the high pressure region 111 toward the suction side portion 96 creates a blocking effect that discourages over-tip leakage flow and ejected coolant flow from spilling over the tip shroud 22 into the suction side 40 of the airfoil 32. In an exemplary engine configuration in accordance with the illustrated embodiments, a pressure side to suction side leakage was measured to be reduced by about 50% from a baseline configuration without the inventive embodiments, as determined by computational fluid dynamics analysis carried out along a plane cutting through the entire blade on the camber line of the airfoil. Furthermore, the ramped contour of the mid portion 92 along with the curved contour of the pressure side portion 94 and/or suction side portion 96 creates a significant pressure gradient at the forward edge of the shroud in the direction from the suction side to the pressure side. The above effect may be illustrated in FIG. 11, which depicts a variation in pressure from a pressure side edge (PS) to a suction side edge (SS) in a forward section of a contoured tip shroud. In the drawing, the curve 121 corresponds to a configuration having a cutout at the mid portion in combination with a radially inwardly curved contouring at the pressure side portion, while the curve 122 corresponds to a configuration having a cutout at the mid portion in combination with a radially inwardly curved contouring at the pressure side portion and radially outwardly curved contouring at the suction side portion. As seen, the latter configuration provides a larger pressure gradient at the forward section of the shroud. In both of the above configurations, the large pressure gradient at the forward section drives more of the gas path fluid into flowing across the circumferential pitch P between the adjacent blades as indicated in FIG. 9, thereby discouraging over-tip leakage flow from flowing from the pressure side to the suction side of the airfoil.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine blade comprising:

a generally elongated airfoil having a leading edge, a trailing edge, a pressure side and a suction side on a side opposite to the pressure side, a shroud coupled to a tip of the airfoil at a radially outer end of the airfoil, wherein the shroud extends in a direction generally from the pressure side toward the suction side and extends circumferentially in a turbine engine, wherein a knife edge seal extends radially outward from the shroud, the shroud comprising:

a mid portion positioned directly over the tip of the airfoil and comprising a ramped radially outer surface extending from a first edge to a second edge in the direction from the pressure side toward the suction side, the second edge being positioned further radially inward than the first edge, and a pressure side portion positioned upstream of the pressure side of the airfoil and extending from the first edge to a pressure side edge of the shroud, the pressure side portion being curved radially inward, wherein a radially inner surface of the pressure side portion forms a concave surface and a radially outer surface of the pressure side portion forms a convex surface, the pressure side edge being positioned further radially inward than the first edge.

2. The turbine blade according to claim 1, wherein a plurality of coolant ejection holes are positioned on the ramped radially outer surface of the mid portion, the plurality of coolant ejection holes being connected fluidically to an interior of the airfoil.

3. The turbine blade according to claim 1, wherein the mid portion is formed by a cutout defining a region of reduced mass of the shroud over the tip of the airfoil.

4. The turbine blade according to claim 1, wherein the second edge is generally aligned with a contour of the suction side at the tip of the airfoil, and the first edge is generally aligned with a contour of the pressure side at the tip of the airfoil.

5. The turbine blade according to claim 1, wherein the radially inner surface and the radially outer surface of the pressure side portion are connected at the pressure side edge of the shroud.

6. The turbine blade according to claim 1, wherein the shroud has a forward section extending from the knife edge seal toward the leading edge and an aft section extending from the knife edge seal toward the trailing edge, wherein the mid portion and the pressure side portion are positioned at the forward section of the shroud.

7. The turbine blade according to claim 1, wherein the mid portion of the shroud further includes a wall surface extending radially outward from the second edge to a third edge.

8. The turbine blade according to claim 7, wherein the ramped radially outer surface makes an angle with the wall surface, the angle varying in a direction from the leading edge to the trailing edge as a function of a profile of the airfoil at the tip.

9. The turbine blade according to claim 7, wherein the shroud further comprises a suction side portion positioned downstream of the suction side of the airfoil, the suction side portion extending from the third edge to a suction side edge of the shroud, the suction side portion being curved radially outward, wherein a radially inner surface of the suction side portion forms a convex surface and a radially outer surface of the suction side portion forms a concave surface, the suction side edge being positioned further radially outward than the third edge.

10. A turbine blade comprising:

a generally elongated airfoil having a leading edge, a trailing edge, a pressure side and a suction side on a side opposite to the pressure side, a shroud coupled to a tip of the airfoil at a radially outer end of the airfoil, wherein the shroud extends in a direction generally from the pressure side toward the suction side and extends circumferentially in a turbine engine, wherein a knife edge seal extends radially outward from the shroud, the shroud comprising:

a mid portion positioned directly over the tip of the airfoil and comprising a ramped radially outer surface extending from a first edge to a second edge in the direction from the pressure side toward the suction side, the second edge being positioned further radially inward than the first edge, the mid portion further including a wall surface extending radially outward from the second edge to a third edge, and a suction side portion positioned downstream of the suction side of the airfoil, the suction side portion extending from the third edge to a suction side edge of the shroud, the suction side portion being curved radially outward, wherein a radially inner surface of the suction side portion forms a convex surface and a radially outer surface of the suction side portion forms a concave surface, the suction side edge being positioned further radially outward than the third edge.

11. The turbine blade according to claim 10, wherein a plurality of coolant ejection holes are positioned on the ramped radially outer surface of the mid portion, the plurality of coolant ejection holes being connected fluidically to an interior of the airfoil.

12. The turbine blade according to claim 10, wherein the mid portion is formed by a cutout defining a region of reduced mass of the shroud over the tip of the airfoil.

13. The turbine blade according to claim 10, wherein the second edge is generally aligned with a contour of the suction side at the tip of the airfoil, and the first edge is generally aligned with a contour of the pressure side at the tip of the airfoil.

14. The turbine blade according to claim 10, wherein the radially inner surface and the radially outer surface of the suction side portion are connected at the suction side edge of the shroud.

15. The turbine blade according to claim 10, wherein the shroud has a forward section extending from the knife edge seal toward the leading edge and an aft section extending from the knife edge seal toward the trailing edge, wherein the mid portion and the suction side portion are positioned at the forward section of the shroud.

16. The turbine blade according to claim 10, wherein the ramped radially outer surface makes an angle with the wall surface, the angle varying in a direction from the leading edge to the trailing edge as a function of a profile of the airfoil at the tip.

17. The turbine blade according to claim 10, wherein the suction side edge of the shroud intersects the knife edge seal at 40-60% of a radial height of the knife edge seal.

18. A turbine stage comprising:

a row of turbine blades arranged circumferentially spaced apart to define respective passages therebetween for channeling a main gas flow, each turbine blade comprising:

a generally elongated airfoil having a leading edge, a trailing edge, a pressure side and a suction side on a side opposite to the pressure side, a shroud coupled to a tip of the airfoil at a radially outer end of the airfoil, wherein the shroud extends in a direction generally from the pressure side toward the suction side and extends circumferentially in the turbine stage, wherein a knife edge seal extends radially outward from the shroud, the shroud of each blade comprising:

a mid portion positioned directly over the tip of the airfoil and comprising a ramped radially outer surface extending from a first edge to a second edge in the direction from the pressure side toward the suction side, the second edge being positioned further radially inward than the first edge, the mid portion further including a wall surface extending radially outward from the second edge to a third edge, a pressure side portion positioned upstream of the pressure side of the airfoil and extending from the first edge to a pressure side shroud edge, the pressure side portion being curved radially inward, wherein a radially inner surface of the pressure side portion forms a concave surface and a radially outer surface of the pressure side portion forms a convex surface, the pressure side shroud edge being positioned further radially inward than the first edge, and a suction side portion positioned downstream of the suction side of the airfoil and extending from the third edge to a suction side shroud edge, the suction side portion being curved radially outward, wherein a radially inner surface of the suction side portion forms a convex surface and a radially outer surface of the suction side portion forms a concave surface, the suction side shroud edge being positioned further radially outward than the third edge, wherein a circumferential gap is defined between the suction side shroud edge of a first turbine blade and the pressure side shroud edge of a circumferentially adjacent second turbine blade.

19. The turbine stage according to claim 18, wherein a plurality of coolant ejection holes are positioned on the ramped radially outer surface of the mid portion of each shroud, the plurality of coolant ejection holes being connected fluidically to an interior of the airfoil.

20. The turbine stage according to claim 18, wherein each shroud has a forward section extending from the knife edge seal toward the leading edge of the respective airfoil and an aft section extending from the knife edge seal toward the trailing edge of the respective airfoil, wherein the mid portion, pressure side portion and the suction side portion of each shroud are positioned at the forward section of the respective shroud.

* * * * *